US005347343A

United States Patent [19]

Ohtsuka et al.

[11] Patent Number: 5,347,343

[45] Date of Patent: Sep. 13, 1994

[54] PHOTOSENSITIVE DRUM CARTRIDGE AND AN IMAGE FORMING APPARATUS USING THE SAME

[75] Inventors: Yoshinori Ohtsuka, Yamatokoriyama; Hideki Umeda, Tenri; Toyokazu Mori, Yamatokoriyama; Masaru Tsuji, Nara; Atsuyuki Katoh, Tenri, all of Japan

[73] Assignee: Sharp Kabushiki Kaisha, Osaka, Japan

[21] Appl. No.: 88,876

[22] Filed: Jul. 8, 1993

[30] Foreign Application Priority Data

Jul. 16, 1992 [JP] Japan ..... 4-189182

[51] Int. Cl.[5] ..... G03G 15/00

[52] U.S. Cl. ..... 355/200; 355/210; 355/211; 355/212

[58] Field of Search ..... 355/200, 210, 211, 212

[56] References Cited

U.S. PATENT DOCUMENTS

| | | | |
|---|---|---|---|
| 3,994,053 | 11/1976 | Hunt | 355/211 X |
| 4,040,157 | 8/1977 | Shanly | 355/211 X |
| 4,299,474 | 11/1981 | Ernst et al. | 355/200 |
| 4,326,793 | 4/1982 | Buholtz | 355/211 X |
| 4,376,579 | 3/1983 | Wakao | 355/211 |
| 4,386,839 | 6/1983 | Kuwagai et al. | 355/200 |
| 4,575,221 | 3/1986 | Onoda et al. | 355/200 |
| 5,151,734 | 9/1992 | Tsuda et al. | 355/200 |

FOREIGN PATENT DOCUMENTS

| | | | |
|---|---|---|---|
| 62-114250 | 5/1986 | Japan . | |
| 0314255 | 12/1989 | Japan | 355/210 |
| 0026865 | 1/1992 | Japan | 355/210 |

*Primary Examiner*—Matthew S. Smith

*Attorney, Agent, or Firm*—David G. Conlin; George W. Neuner; Kevin J. Fournier

[57] ABSTRACT

The object of the invention is to reduce the number of parts which are required for supporting a photosensitive drum in a photosensitive drum cartridge. Engaging bodies of supporting members are inserted through mounting holes of a cartridge main body. Supporting shafts are inserted into supporting shaft insertion holes formed on the sides of a photosensitive drum. When the supporting members are rotated, the side walls of the cartridge main body are fitted into gaps between flat plates and engaging pieces. The supporting members are positioned with respect to and fixed to the cartridge main body, whereby the photosensitive drum is supported in the cartridge main body.

4 Claims, 18 Drawing Sheets

Fig. 4 (1)
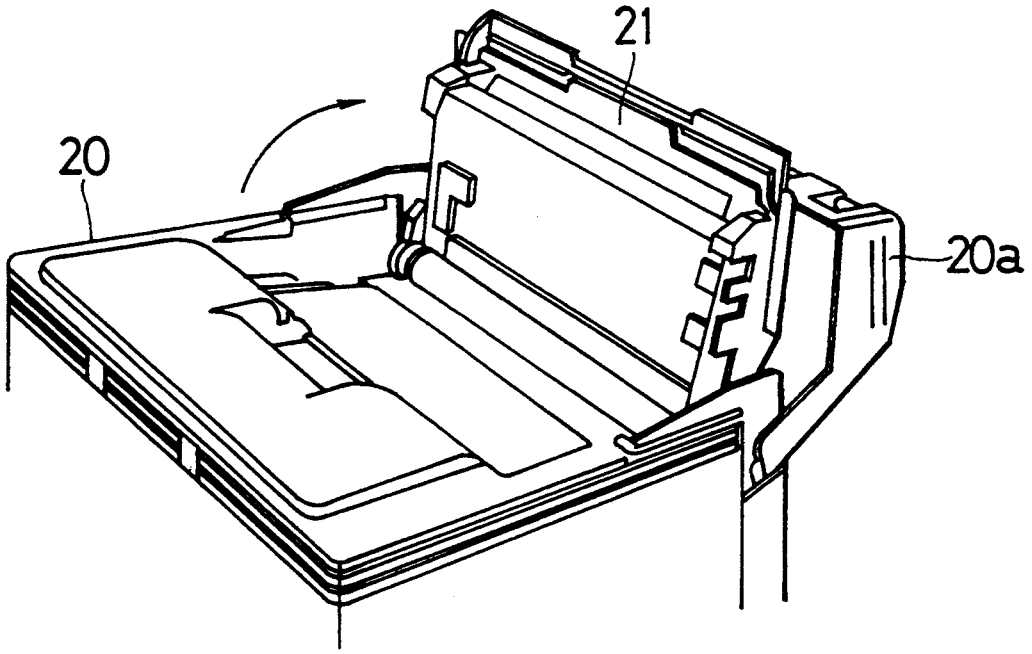
Fig. 4 (2)
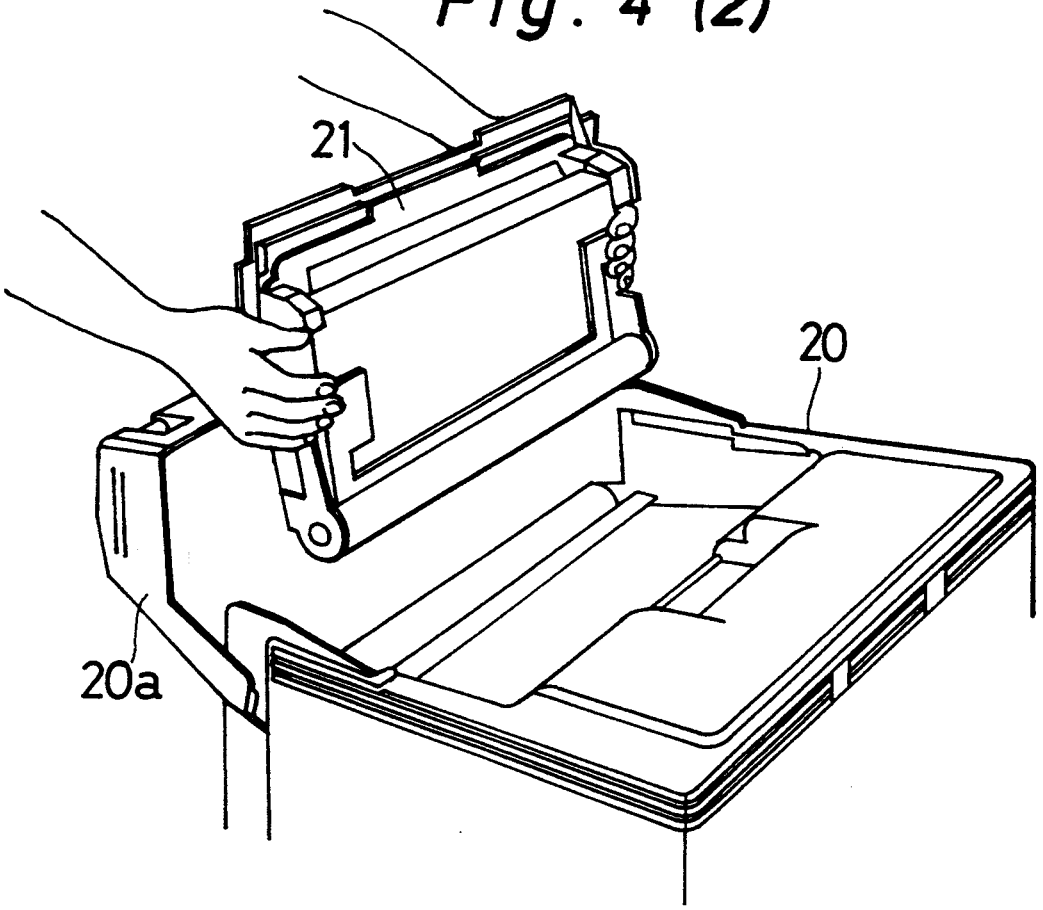

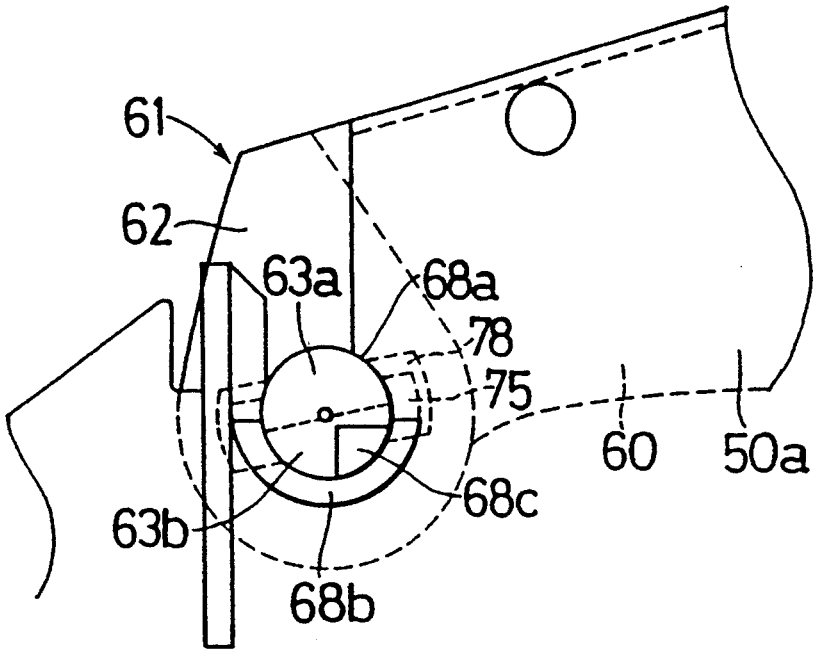
Fig. 16
Fig. 17
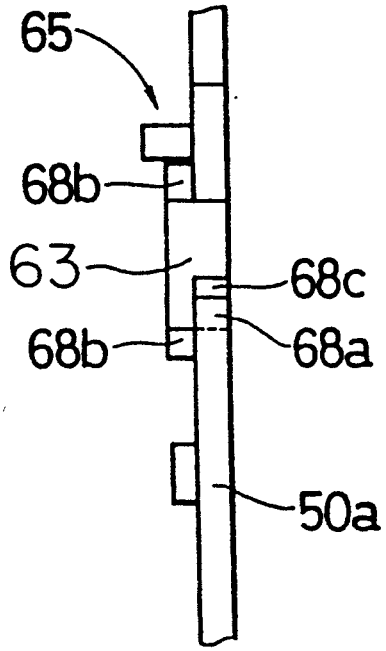

PHOTOSENSITIVE DRUM CARTRIDGE AND AN IMAGE FORMING APPARATUS USING THE SAME

BACKGROUND OF THE INVENTION

1. Field of the Invention

The present invention relates to an image forming apparatus such as a copying machine or a laser beam printer which is provided with a detachable photosensitive drum cartridge.

2. Description of the Related Art

In a related art image forming apparatus such as a copying machine or a laser beam printer, as shown in FIGS. 18 to 20, a photosensitive drum cartridge 2 is mounted detachably in the main body 1 of the apparatus, and a photosensitive drum is detachably supported by the main body 3 of the cartridge.

An assembling member 4 for fixing to the apparatus main body 1 is mounted to the cartridge main body 3. As shown in FIG. 18, the assembling member 4 comprises a flexible handle portion 5, and an assembling portion 6 which supports the handle portion 5 and is screwed to the cartridge main body 3.

The handle portion 5 has a substantially V-like shape consisting of a fixed handle piece 7 fixed to the assembling portion 6, and a movable handle piece 9 which is swingably connected to the fixed handle piece 7 through a resilient U-like rib 8.

As shown in FIG. 19, at the center of the outer side wall of the movable handle piece 9, formed is an engaging claw 12 which is to engage with an engaging hole 11. The engaging hole 11 is formed at the upper portion of a guide groove 10 formed in the apparatus main body 1. Therefore, when the handle portion 5 of the assembling member 4 is pressed into the guide groove 10 as shown in FIG. 20, the engaging claw 12 engages with the engaging hole 11, thereby positioning the photosensitive drum cartridge 2 in the vertical direction.

When the photosensitive drum cartridge 2 is removed from the apparatus main body 1, the movable handle piece 9 is pressed toward the fixed handle piece 7 so that the engaging claw 12 is disengaged from the engaging hole 11, thereby performing the removal of the cartridge.

The assembling member 4 further comprises a finger insertion hole 13 and a screw insertion hole 14, and the cartridge main body 3 comprises a boss 15 which is to be guided through the guide groove 10 so that the photosensitive drum cartridge 2 is correctly positioned with respect to the apparatus main body 1.

In the photosensitive drum cartridge 2 in the prior art, the cartridge main body 3 requires members such as shafts and bearings for rotatably supporting the photosensitive drum, and fastening parts such as screws for fixing these members to the cartridge main body 3, resulting in the increased number of parts. This causes the step of assembling the photosensitive drum cartridge 2 to be cumbersome, thereby increasing the cost.

The positioning of the photosensitive drum cartridge 2 in the vertical direction with respect to the apparatus main body 1 is effected by the engagement of the engaging claw 12 of the assembling member 4 and the engaging hole 11 of the apparatus main body 1. However, the constitution for positioning the photosensitive drum cartridge 2 in the horizontal direction is not sufficiently considered, with the result that the photosensitive drum cartridge 2 is liable to be dislocated in the horizontal direction.

SUMMARY OF THE INVENTION

In view of the problems described above, the invention has an object of providing a photosensitive drum cartridge having a reduced number of parts. It is another object of the invention to provide an image forming apparatus in which the accuracy of positioning a photosensitive drum cartridge with respect to the main body of the image forming apparatus is improved.

In a photosensitive drum cartridge according to the invention, as shown in FIG. 1, a photosensitive drum cartridge main body 40 is provided with a supporting member 41 for supporting a photosensitive drum 22. The supporting member 41 comprises a supporting shaft 42 for rotatably supporting the photosensitive drum 22, and a base body 43 integrated with the supporting shaft 42 and for positioning the supporting shaft 42 with respect to the photosensitive drum cartridge main body 40.

In another photosensitive drum cartridge according to the invention, as shown in FIG. 8, the supporting member 41 is made of an elastic resin.

In a further photosensitive drum cartridge according to the invention, as shown in FIG. 12, a positioning boss 63 for positioning a photosensitive drum cartridge main body 60 with respect to an image forming apparatus main body 50 is integrally formed on a base body 73 of a supporting member 61.

A still further photosensitive drum cartridge according to the invention comprises positioning means which performs the positioning of the supporting member by superposing a projection formed on the supporting member on a positioning hole formed in the cartridge main body.

Another image forming apparatus according to the invention comprises an image forming apparatus main body, and a photosensitive drum cartridge which is to be mounted to the image forming apparatus main body. A positioning boss is formed on the photosensitive drum cartridge. The image forming apparatus main body is provided with an insertion portion into which the positioning boss is to be inserted. In the insertion portion, formed is a positioning member for positioning the positioning boss in the vertical and horizontal directions through the rotation of the photosensitive drum cartridge.

When a photosensitive drum cartridge 21 is to be assembled, the supporting shaft 42 of the supporting member 41 is inserted into the photosensitive drum cartridge main body 40 so as to rotatably support the photosensitive drum 22. Using the resilience of the base body 43 of the supporting member 41, the base body 43 is positioned with respect to the photosensitive drum main cartridge main body 40, whereby the photosensitive drum 22 is supported in the cartridge body 40.

When the photosensitive drum cartridge 51 is to be positioned with respect to the image forming apparatus main body 50, the positioning boss 63 of the supporting member 61 is inserted into the insertion portion 65 of the image forming apparatus main body 50. When the photosensitive drum cartridge 51 is rotated to a predetermined position, the positioning boss 63 is fixed in the vertical and horizontal directions by the positioning means 66. Accordingly, the photosensitive drum cartridge 51 can be accurately positioned with respect to the image forming apparatus body 50.

As apparent from the above description, the photosensitive drum can be supported in the photosensitive drum cartridge main body only by the supporting member. Therefore, a plurality of members which are necessary in the prior art for supporting the photosensitive drum on the photosensitive drum cartridge main body can be omitted. This allows the productivity of the step of assembling the photosensitive drum to be improved, thereby reducing the production cost.

The photosensitive drum cartridge is positioned with respect to the image forming apparatus main body by the positioning boss of the supporting members for supporting the photosensitive drum. Accordingly, it is not required to separately install members required for performing the positioning, resulting in that the number of parts can be reduced.

The positioning boss can be positioned in the vertical and horizontal directions only by inserting the positioning boss into the insertion portion and rotating the photosensitive drum cartridge, thereby attaining an excellent effect that the photosensitive drum cartridge can be accurately positioned with respect to the image forming apparatus main body.

BRIEF DESCRIPTION OF THE DRAWINGS

Other and further objects, features, and advantages of the invention will be more explicit from the following detailed description taken with reference to the drawings wherein:

FIGS. 4 (1) and (2) are diagrams showing the photosensitive drum cartridge which is detached from the printer main body;

FIG. 16 is a side view showing the state where the photosensitive drum cartridge is mounted to the printer main body;

FIG. 17 is a plan view of the insertion portion;

DETAILED DESCRIPTION OF THE INVENTION

Figure 1:
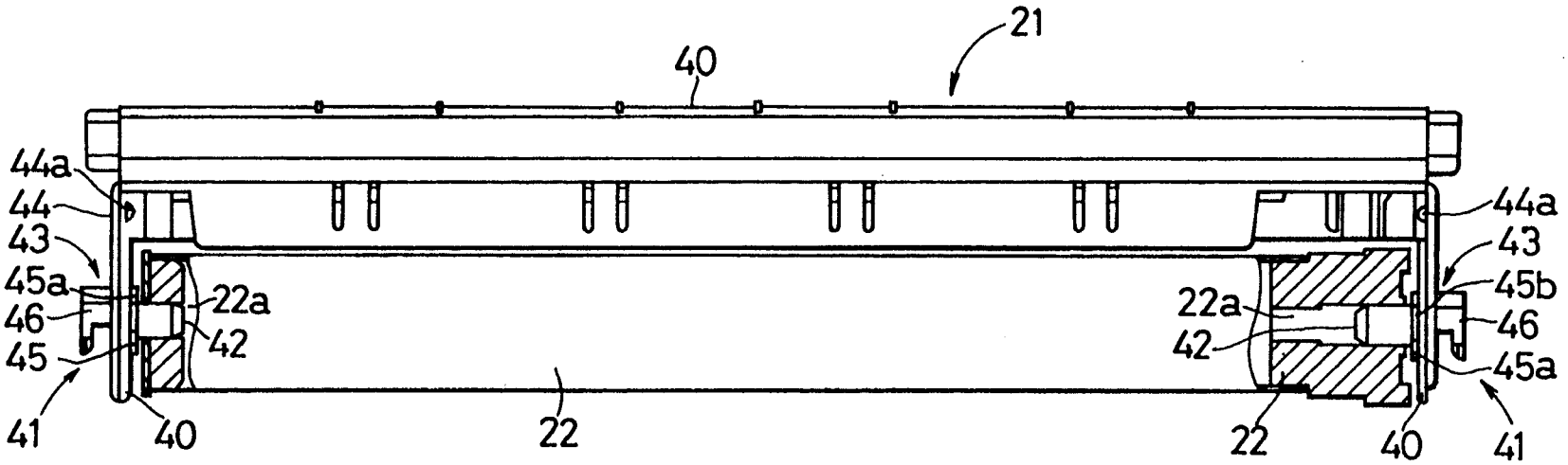
FIG. 1 is a partially cutaway front view of a photosensitive drum cartridge of a first embodiment of the invention.

Now referring to the drawing, preferred embodiments of the invention are described below.

<First Embodiment>

Figure 2:
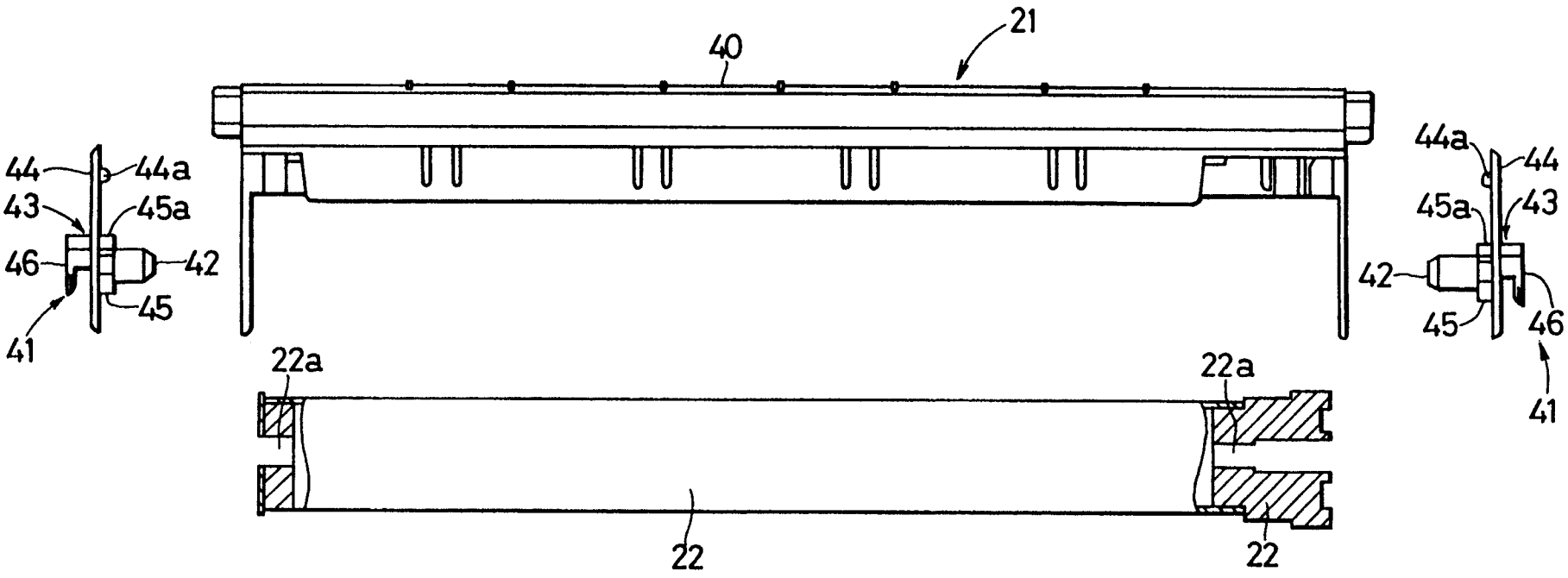
FIG. 2 is a front view showing the photosensitive drum cartridge of FIG. 1 which is disassembled into a cartridge body, a photosensitive drum and a supporting member.
Figure 3:
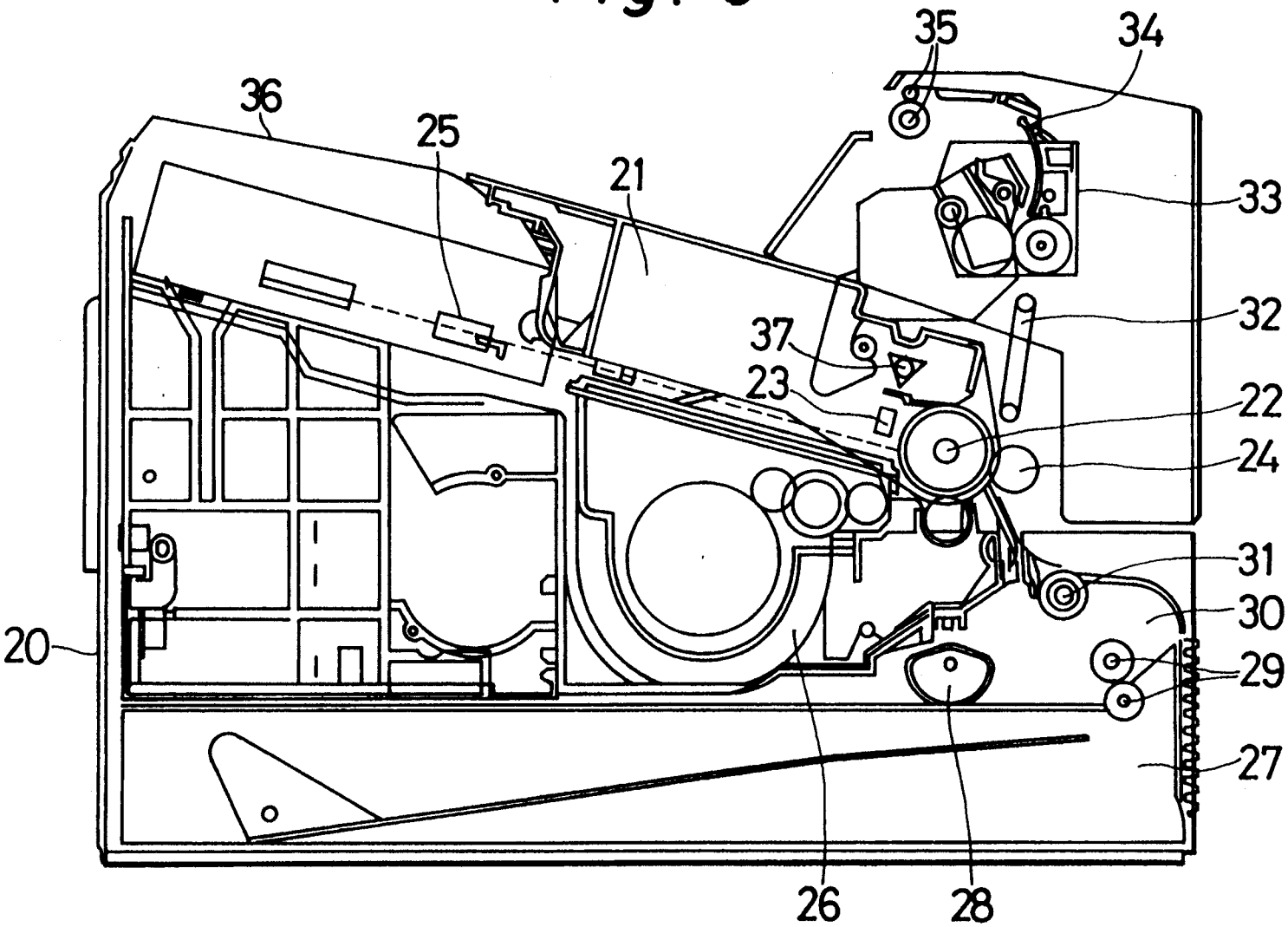
FIG. 3 is a diagram showing the configuration of a laser beam printer in which the photosensitive drum cartridge is attached.
Figure 5:
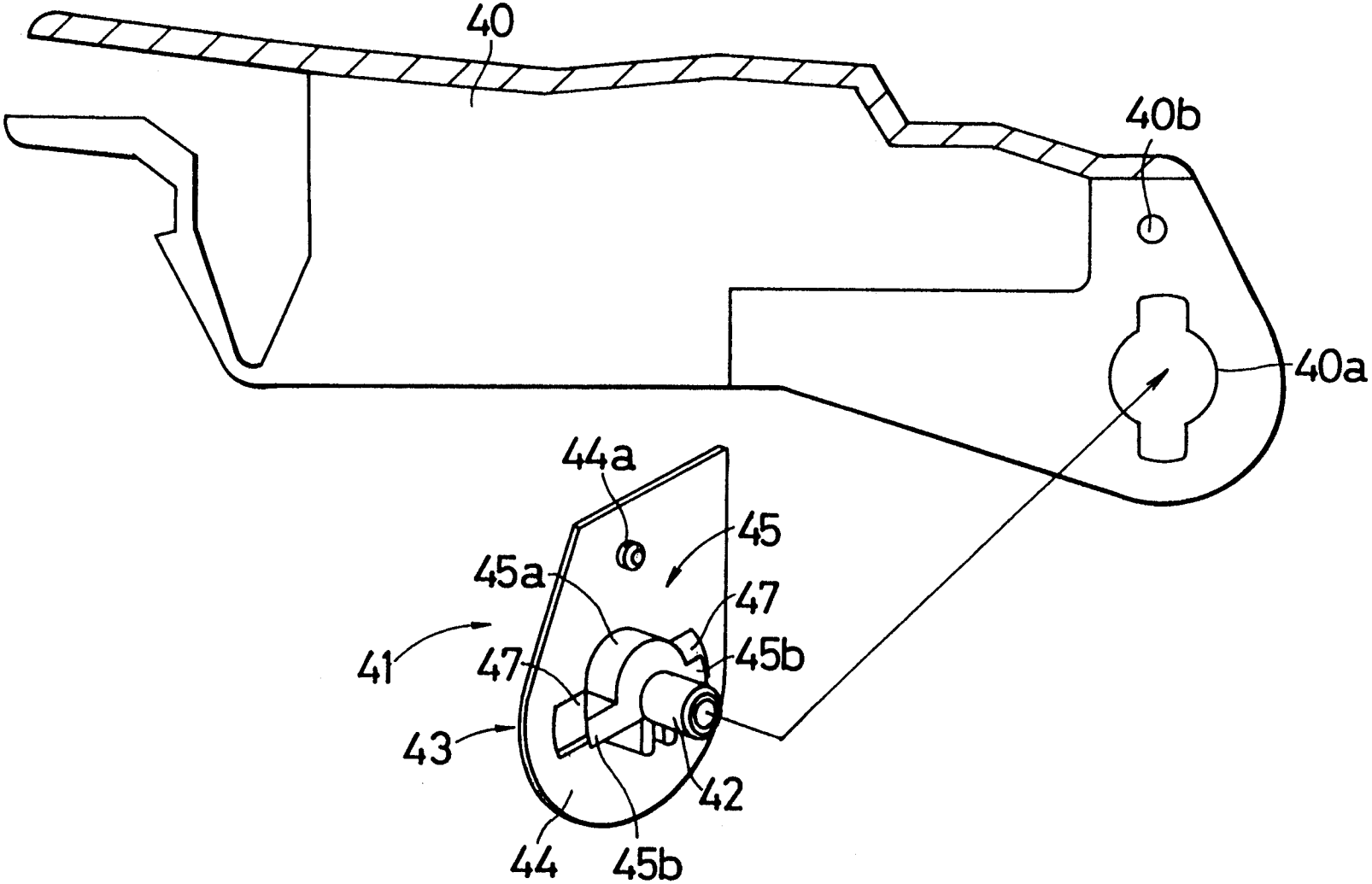
FIG. 5 is a perspective view of a supporting member which is to be mounted to an mounting hole of the cartridge main body.
Figure 6:
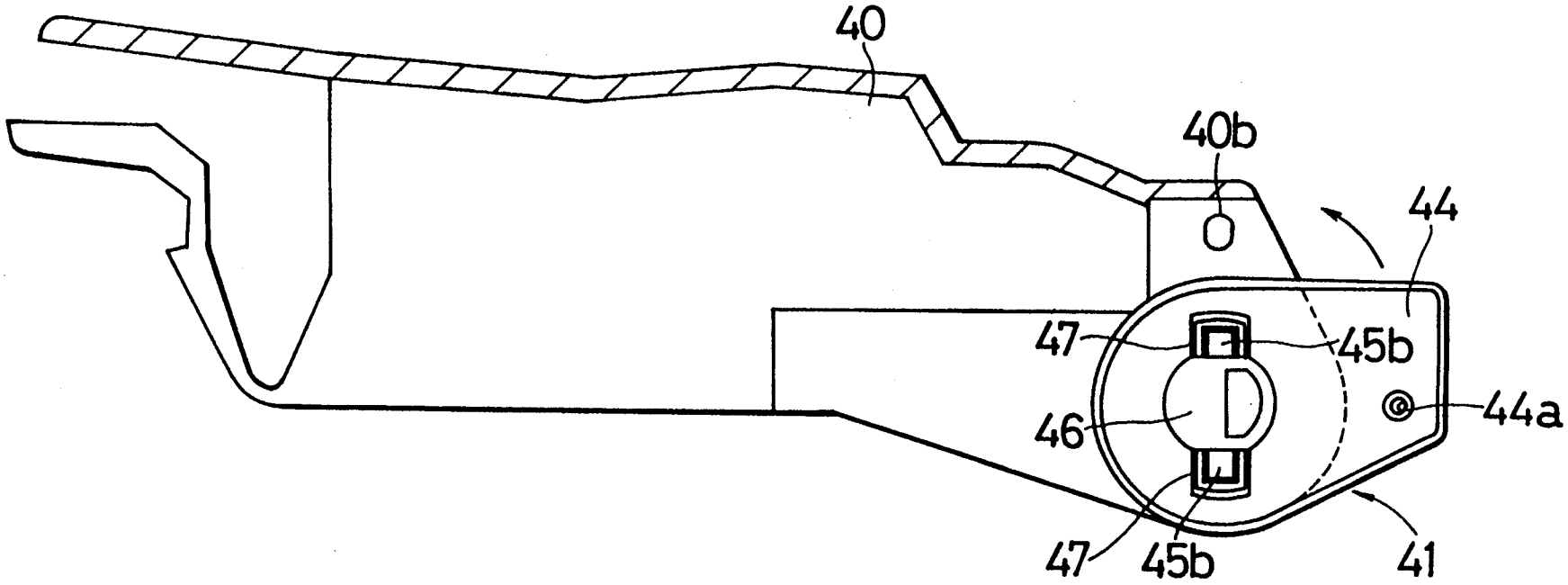
FIG. 6 is a side view of the cartridge main body at the state where the supporting member has not yet been subjected to the positioning.
Figure 7:
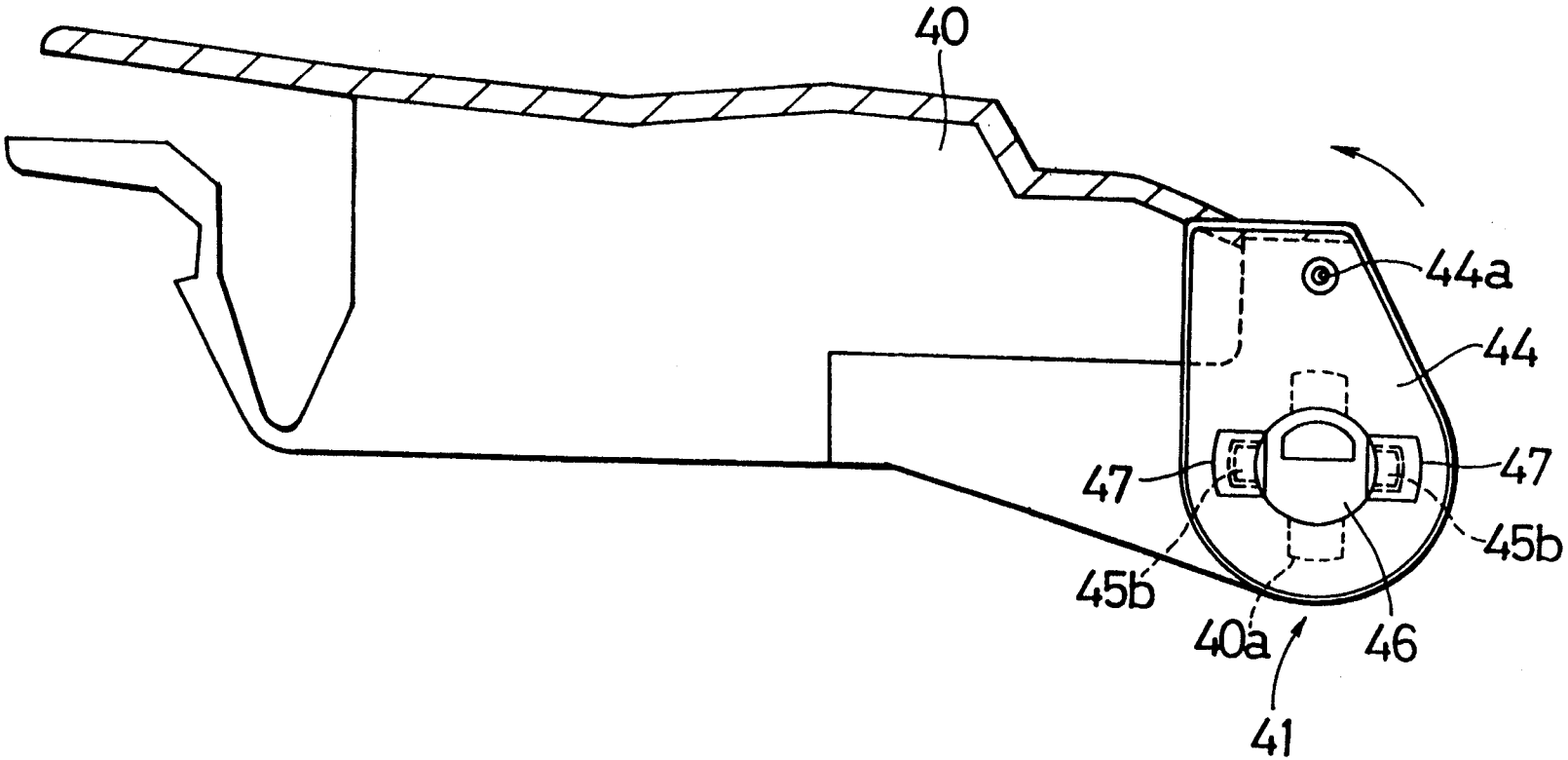
FIG. 7 is a side view of the cartridge main body at the state where the supporting member has been subjected to the positioning.
Figure 8:
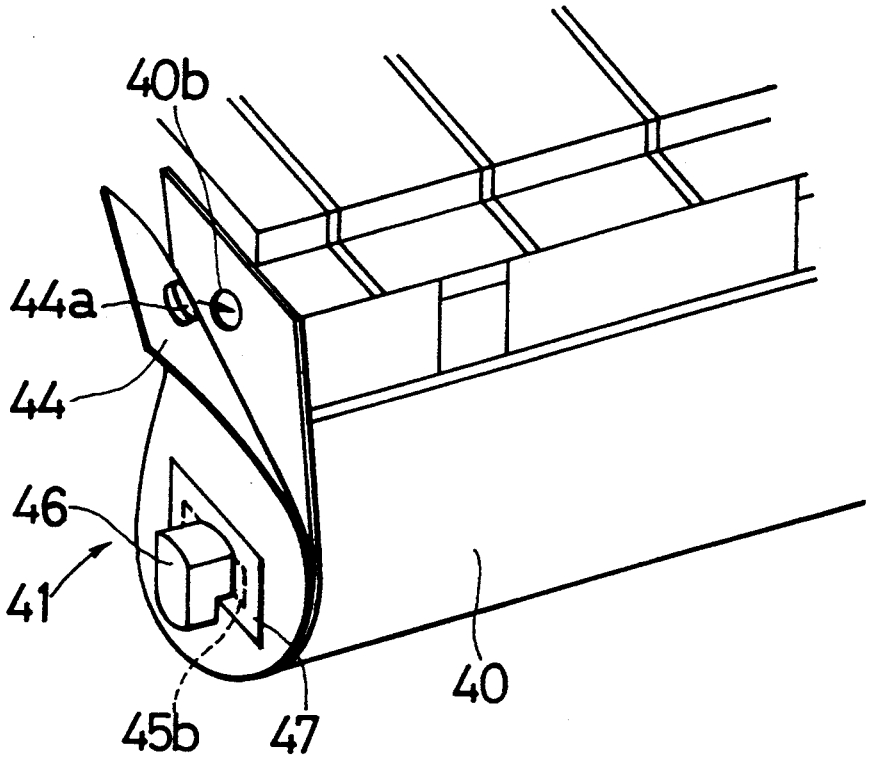
FIG. 8 is a perspective view of the supporting member at the state where a projection is fitted into a positioning hole.

FIG. 1 is a partially cutaway front view of a photosensitive drum cartridge of a first embodiment of the invention, FIG. 2 is a view showing the photosensitive drum cartridge of FIG. 1 which is disassembled into a cartridge body, a photosensitive drum and a supporting member, FIG. 3 is a diagram showing the configuration of a laser beam printer in which the photosensitive drum cartridge is attached, FIG. 4 is a diagram showing the photosensitive drum cartridge which is detached from the printer main body, FIG. 5 is a perspective view of a supporting member which is to be mounted to a mounting hole of the cartridge main body, FIG. 6 is a side view of the cartridge main body at the state where the supporting member has not yet been subjected to positioning, FIG. 7 is a side view of the cartridge main body at the state where the supporting member has been subjected to positioning, and FIG. 8 is a perspective view of the supporting member at the state where a projection is fitted into a positioning hole.

First, the configuration of the laser beam printer in which the photosensitive drum cartridge of the first embodiment is mounted will be roughly described with reference to FIG. 3. The printer 20 comprises the photosensitive drum cartridge 21, a photosensitive drum 22, a main charger 23, a transfer roller 24, a semiconductor laser device 25 for generating laser beams, a developing unit 26, a sheet feeding cassette 27, a pick-up roller 28, sheet feeding rollers 29, a sheet conveying path 30, a registration roller 31, a conveyor belt 32 for conveying a sheet to which an image has been transferred, a fixing unit 33, a discharging path 34, discharging rollers 35, and a face-down tray 36.

As shown in FIG. 4, a photosensitive drum cartridge is attached and detached easily from the printer main body 20 by hand after the opening a upper assembly 20*a* hinged to the printer main body 20 so as to be rotatable.

The photosensitive drum 22, the main charger 23, a cleaning device 37, and so on are incorporated in the cartridge main body 40 of the photosensitive drum cartridge 21. On the both sides of the cartridge main body 40, mounted are a pair of supporting members 41 for rotatably supporting the photosensitive drum 22.

As shown in FIG. 5, on each of the both sides of the cartridge main body 40, formed are a mounting hole 40*a* to which the supporting member 41 is to be mounted, and a positioning hole 40*b* for positioning the supporting member 41 above the mounting hole 40*a*. The mounting holes 40*a* have a rectangular shape which elongates in the vertical direction and the right and left sides are round out.

Each of the supporting members 41 is made of an elastic resin, and comprises as shown in FIGS. 1, 2 and 5 a supporting shaft 42 for rotatably supporting the photosensitive drum 22, and a base body 43 integrated with the supporting shaft 42 and for fixing the supporting shaft 42 to the cartridge main body 40.

As shown in FIGS. 1, 2 the supporting shafts 42 are respectively inserted into supporting shaft insertion holes 22*a* which are formed at the center portion of the sides of the photosensitive drum 22, to support the photosensitive drum 22.

As shown in FIG. 5, each of the base bodies 43 comprises a flat plate 44 which has the same shape as that of the front end portion of the side wall of the cartridge main body 40, and an engaging body 45 which is integrally formed at the center of the flat plate 44 and which engages with the respective mounting hole 40*a* of the cartridge main body 40.

A projection 44*a* which is to be fitted into the respective positioning hole 40*b* of the cartridge main body 40 is formed on each of the flat plates 44.

As shown in FIG. 5, each of the engaging bodies 45 consists of an oval projection 45*a* which protrudes from the respective flat plate 44, and a pair of engaging pieces 45*b* which are integrally formed at the right and left sides of the projection 45*a* and separated from the flat plate 44 by a predetermined distance. The supporting shafts 42 project from the center of the respective projection 45*a*.

The engaging bodies 45 can be inserted into the cartridge main body 40 through the mounting holes 40*a*. The gap between each of the projections 45*b* and the flat plate 44 is slightly greater than the thickness of the side wall of the cartridge main body 40.

In FIG. 1, positioning bosses 46 perform the function of positioning the cartridge main body 40 with respect to the image forming apparatus main body 20. Each of the bosses is formed integrally on the outer face of the respective flat plate 44. Holes 47 are formed so that the engaging pieces 45*b* can be visually inspected from the outside of the flat plates 44.

The manner of supporting the photosensitive drum 22 of the photosensitive drum cartridge 21 in the above-described configuration will be described. First, the engaging bodies 45 of the supporting members 41 are inserted through the mounting holes 40*a* of the cartridge main body 40, and the supporting shafts 42 are inserted into the supporting shaft insertion holes 22*a* formed on the sides of the photosensitive drum 22.

At this time, as shown in FIG. 6, the supporting members 41 are at the position rotated by 90 degrees from the usual mounting position of the cartridge main body 40. When the supporting members 41 are rotated so that the projections 44*a* of the supporting members 41 are respectively superposed on the positioning holes 40*b* as shown in FIG. 7, the side walls of the cartridge main body 40 are fitted into the gaps between the flat plates 44 and the engaging pieces 45*b*. Using the resilience of the supporting members 41, the flat plates 44 are then bent outward as shown in FIG. 8, and the projections 44*a* are fitted into the positioning holes 40*b* while visually checking the positional relationship between the projections 44*a* and the positioning holes 40*b*. This causes the supporting members 41 to be positioned with respect to and fixed to the cartridge main body 40, whereby the photosensitive drum 22 is supported in the cartridge main body 40.

In the laser beam printer in which the photosensitive drum cartridge 21 is thus incorporated in the printer main body 20 using the positioning bosses 46, the surface of the photosensitive drum 22 which, as the photosensitive drum 22 rotates, opposes the main charger 23 is charged to a predetermined potential. On the other hand, the semiconductor laser device 25 emits laser beams having the intensity which corresponds to an image to be printed. As indicated by a broken line, the laser beams are guided to the surface of the photosensitive drum 22. Then, only the portions of the surface of the photosensitive drum 22 which are exposed by the laser beams are discharged so that a latent image corresponding to the print image is formed on the surface of the photosensitive drum 22. When the surface portion passes the developing unit 26, the latent image is developed with toner.

On the other hand, a sheet placed in the sheet feeding cassette 27 is conveyed by the pick-up roller 28 and sheet feeding rollers 29 through the sheet conveying path 30 to the registration roller 31. The sheet is sent at a predetermined timing by the registration roller 31 to the photosensitive drum 22, and the toner image is transferred onto the sheet by the transfer roller 24.

The sheet having the transferred toner image is further conveyed through the conveyor belt 32 to the fixing unit 33 in which the toner image is heated to be fixed to the sheet. Thereafter, the sheet is conveyed through the discharging path 34 to be discharged to the face-down tray 36 by the discharging rollers 35.

In this way, the photosensitive drum 22 can be supported only by the supporting members 41. Accordingly, shafts and bearings which are required in the prior art for supporting the photosensitive drum to the cartridge main body, and fastening parts such as screws for fixing the bearings can be omitted. This allows the photosensitive drum cartridge 21 to be easily assembled, thereby reducing the production cost.

<Second Embodiment>

Figure 9:
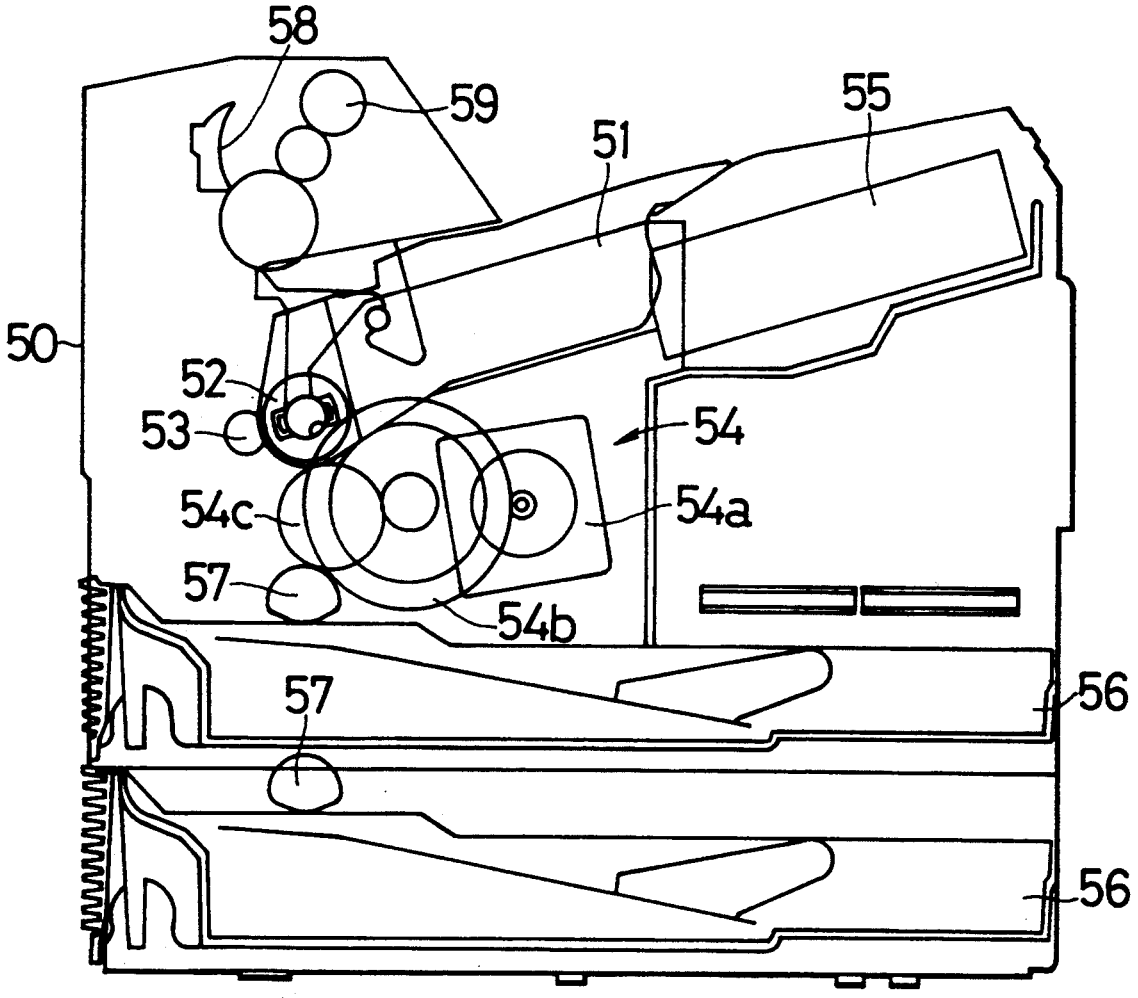
FIG. 9 is a diagram showing the configuration of a laser beam printer in which the photosensitive drum cartridge of a second embodiment is attached.
Figure 10:
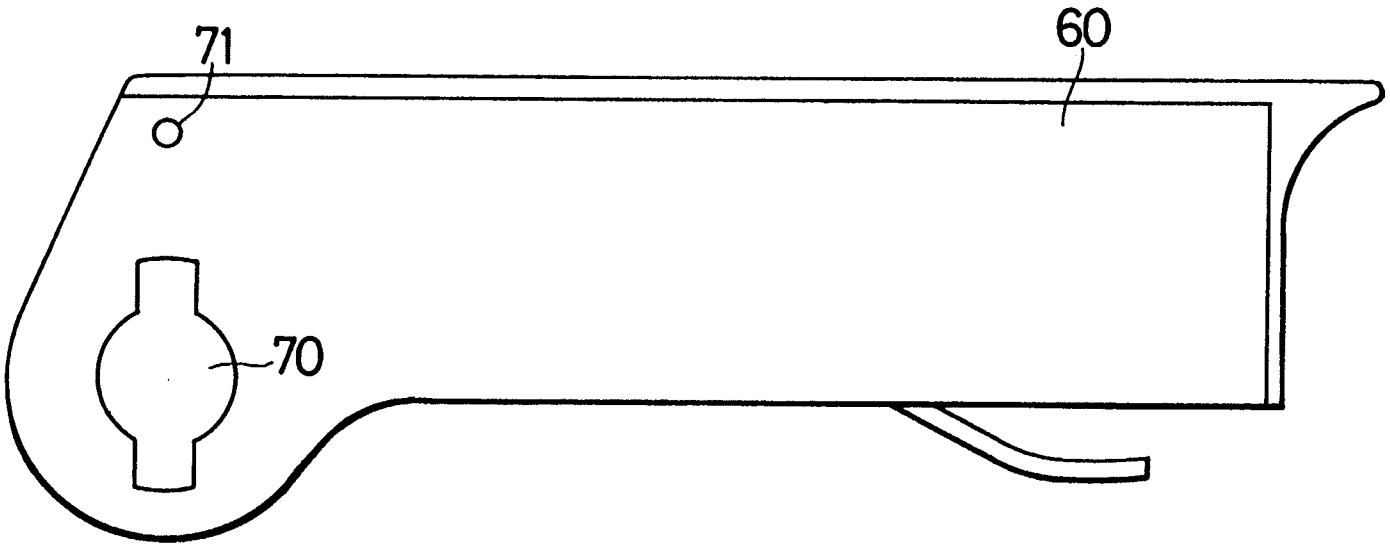
FIG. 10 is a side view of the cartridge main body.
Figure 11:
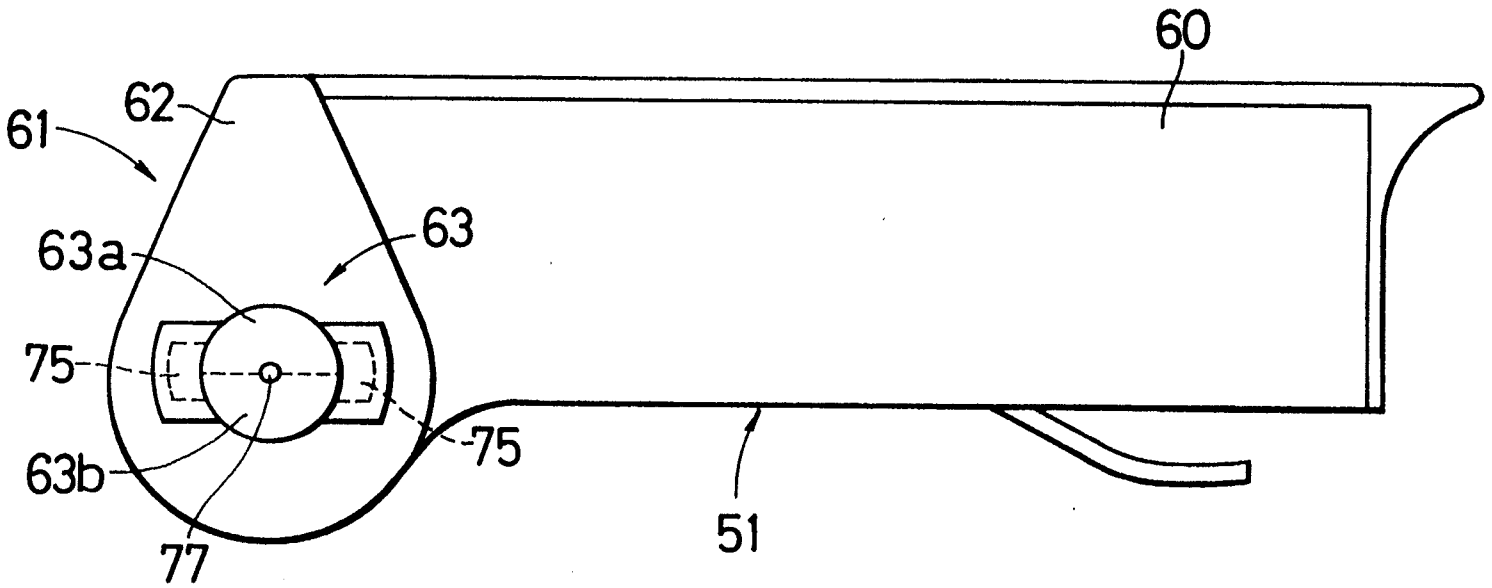
FIG. 11 is a side view of a photosensitive drum cartridge.
Figure 12:
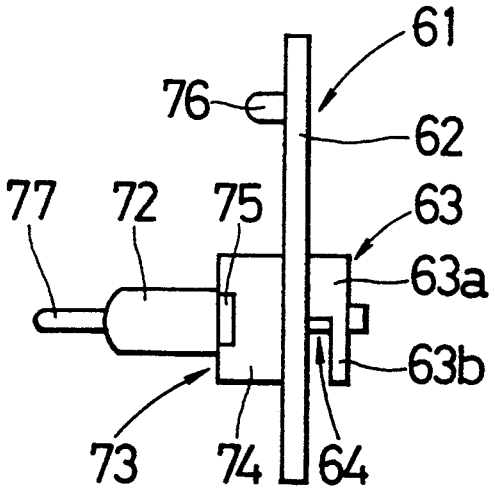
FIG. 12 is a side view of a supporting member.
Figure 13:
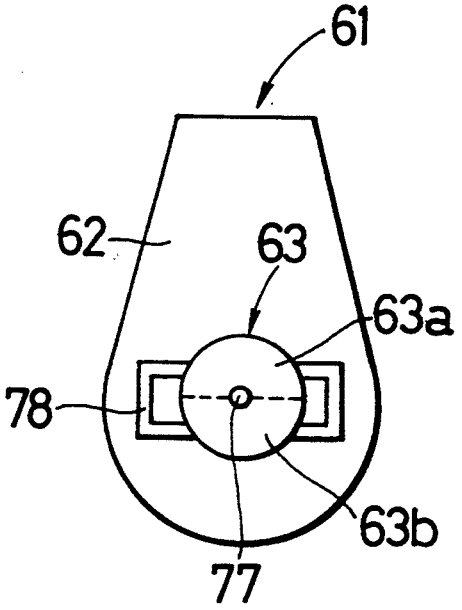
FIG. 13 is a front view of the supporting member.
Figure 14:
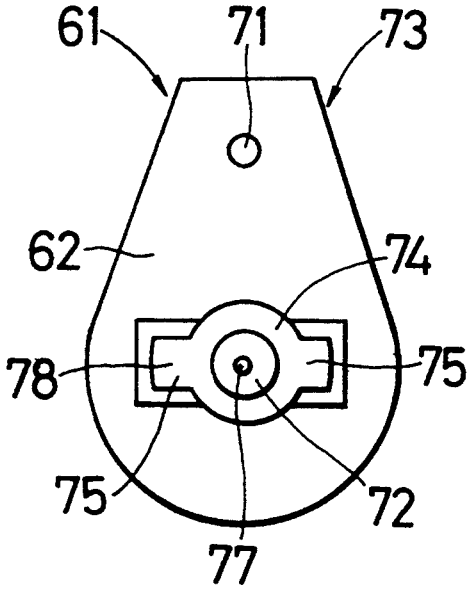
FIG. 14 is a rear view of the supporting member.
Figure 15:
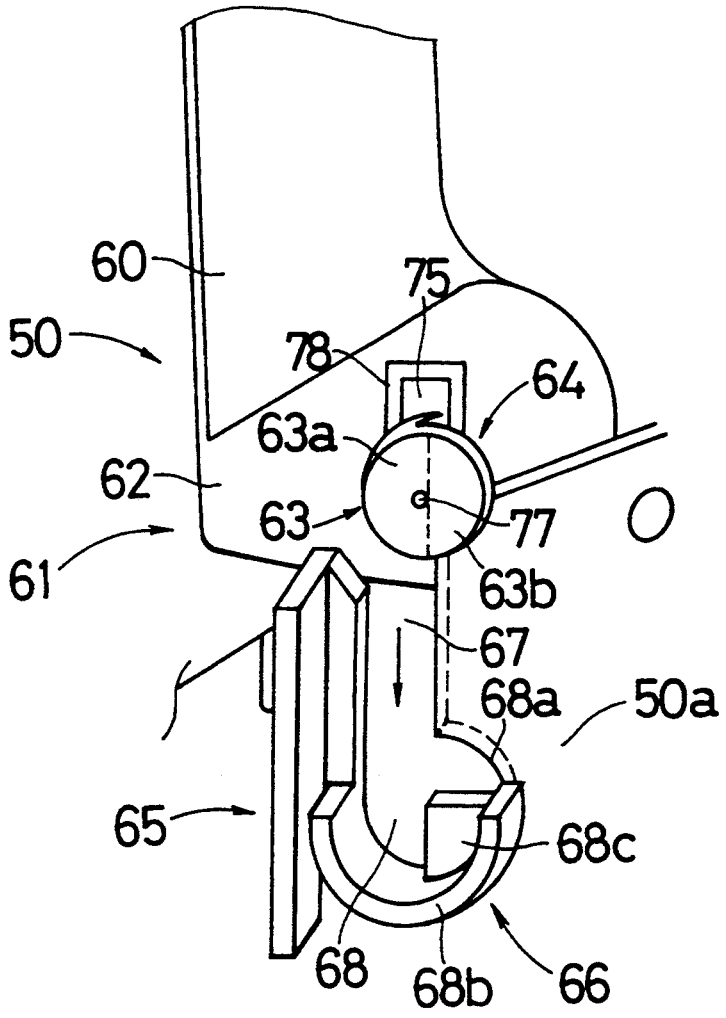
FIG. 15 is a perspective view showing an insertion portion of the printer main body and the supporting member.
Figure 18:
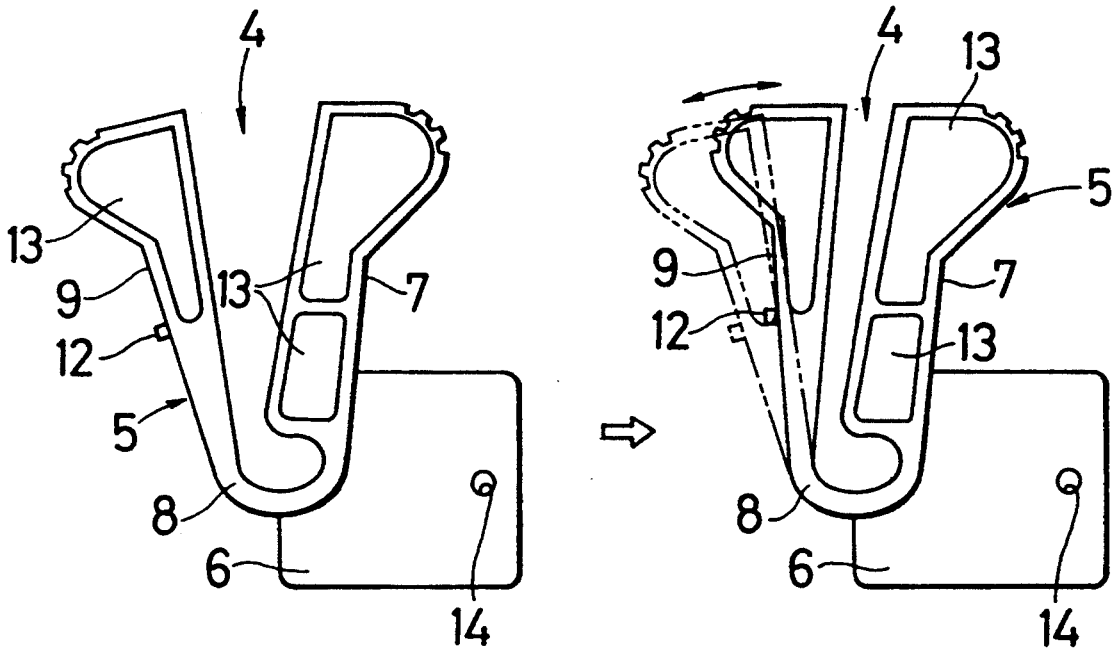
Fig. 18 PRIOR ART
FIG. 18 is a front view of a conventional assembling member.
Figure 19:
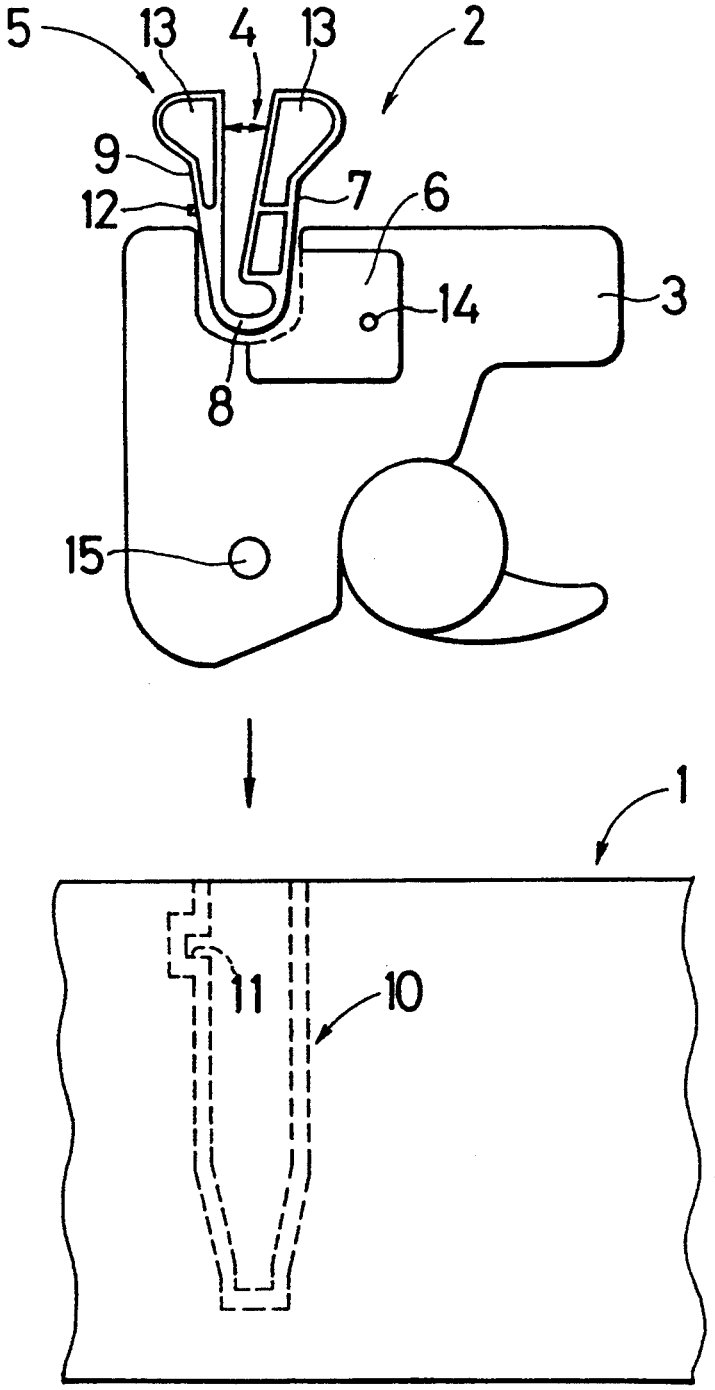
Fig. 19 PRIOR ART
FIG. 19 is a front view showing a conventional photosensitive drum cartridge and printer main body.
Figure 20:
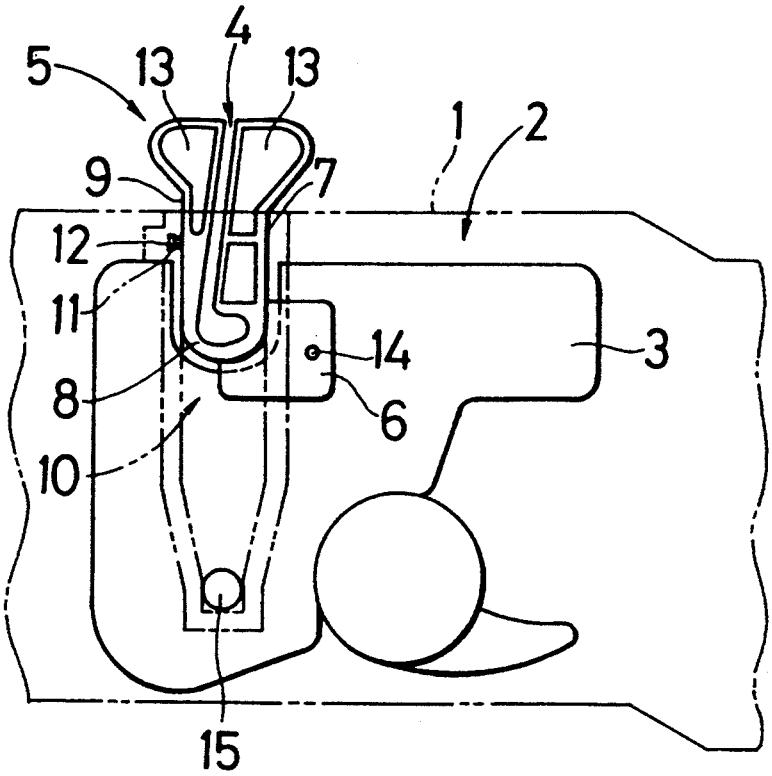
Fig. 20 PRIOR ART
FIG. 20 is a front view showing the state where the conventional photosensitive drum cartridge is inserted into the printer main body.

FIG. 9 is a diagram showing the configuration of a laser beam printer in which the photosensitive drum cartridge of a second embodiment is attached, FIG. 10 is a side view of the cartridge main body, FIG. 11 is a side view of a photosensitive drum cartridge, FIG. 12 is a side view of a supporting member, FIG. 13 is a front view of the supporting member, FIG. 14 is a rear view of the supporting member, FIG. 15 is a perspective view showing an insertion portion of the printer main body and the supporting member, FIG. 16 is a side view showing the state where the photosensitive drum cartridge is mounted to the printer body, and FIG. 17 is a plan view of the insertion portion.

The configuration of the laser beam printer in which the photosensitive drum cartridge of the second embodiment is mounted will be roughly described with reference to FIG. 9. The printer 50 comprises a photosensitive drum cartridge 51, a photosensitive drum 52, a transfer roller 53, a driving portion 54 of a developing unit, a main motor 54*a*, a driving gear 54*b*, a helical gear 54*c*, an optical unit 55, a sheet feeding cassette 56, a pick-up roller 57, a U-turn guide 58, and sheet discharge rollers 59.

In the same manner as the first embodiment, as shown in FIGS. 10 and 11, a pair of supporting members 61 for supporting the photosensitive drum 52 are mounted on the both outer sides of the cartridge main body 60 of the photosensitive drum cartridge 51.

As shown in FIGS. 12, 13 and 14, the supporting members 61 have the same configuration as those used in the first embodiment. In the second embodiment, the configuration for positioning the photosensitive drum cartridge 51 with respect to the printer main body 50 by positioning bosses 63 formed on the outer faces of flat plates 62 of the supporting members 61 will be described.

As shown in FIGS. 12 and 13, each of the positioning bosses 63 comprises a projection 63*a* of a half-cylinder shape and formed integrally on the outer face of the respective flat plate 62, and a positioning piece 63*b* which has a half-disk shape and protrudes from the under portion of the projection 63*a* so as to be separated from the flat plate 62 by a gap 64. The gap 64 is greater than the thickness of a frame 50*a* of the printer main body 50.

As shown in FIGS. 15, 16 and 17, the frame 50*a* of the printer main body 50 is provided with insertion portions 65 into which the positioning bosses 63 are to be inserted. In each of the insertion portions 65, formed is positioning means 66 for positioning the photosensitive drum cartridge 51 with respect to the printer main body 50 by the rotation of the photosensitive drum cartridge 51.

Each of the insertion portions 65 consists of a long groove 67 and an arcuate groove 68. The long groove 67 has a width which is greater than the radius of the projection 63*a* of the positioning boss 63 and smaller than the diameter thereof, and is opened at the upper end. The arcuate groove 68 is continuous with the lower portion of the long groove 67, and has the radius of curvature which is or greater than the radius of the projection 63*a*.

In this configuration, when the photosensitive drum cartridge 51 has the insertion attitude in which the photosensitive drum 22 is positioned at the lower side as shown in FIG. 15, the positioning bosses 63 can be inserted into the long grooves 67. After the positioning bosses 63 enter the arcuate grooves 68, the photosensitive drum cartridge 51 can be rotated about the positioning bosses 63. When the photosensitive drum cartridge 51 is rotated to reach a predetermined position, it has a mounted attitude.

Each of the positioning means 66 consists of an upper side wall 68*a* of the arcuate groove 68 which prevents the respective positioning boss 63 from moving upward, a U-shaped wall 68*b* which prevents the positioning boss 63 from moving downward and protrudes from the lower side wall of the arcuate groove 68, and a fan-shaped rib 68*c* which is to be fitted into the gap 64 so as to prevent the positioning boss 63 from moving horizontally.

The cartridge main body 60 of the embodiment comprises mounting holes 70 for the supporting members 61, and positioning holes 71. Each of the supporting members 61 comprises a supporting shaft 72, a base body 73, an engaging body 74, an engaging piece 75, a projection 76, a grounding pin 77 which penetrates from the supporting shaft 72 to the positioning boss 63, and a hole 78 for visually inspecting the engaging piece 75 from the outside of the flat plate 62.

In above-described configuration, the photosensitive drum cartridge 51 is positioned with respect to the printer main body 50 in the following manner. As shown in FIGS. 15 and 16, the photosensitive drum cartridge 51 is set to have the insertion attitude, and the positioning bosses 63 are then inserted into the long grooves 67 of the frame 50*a*. After the positioning bosses 63 enter the arcuate grooves 68, the photosensitive drum cartridge 51 can be rotated about the positioning bosses 63. The photosensitive drum cartridge 51 is rotated to the predetermined position so as to have the mounted attitude.

At this time, since the side walls of the projections 63*a* are pressed against the upper side walls 68*a* of the arcuate grooves 68 and the side walls of the positioning pieces 63*b* are pressed against the U-shaped walls 68*b*, the photosensitive drum cartridge 51 is fixed in the vertical direction. Furthermore, since the ribs 68*c* are fitted into the gaps 64 of the positioning bosses 63, the photosensitive drum cartridge 51 is fixed in the horizontal direction. This results in that the photosensitive drum cartridge 51 is accurately positioned with respect to the printer main body 50.

The operation of the laser printer and the manner of supporting the photosensitive drum 52 in the photosensitive drum cartridge 51 are the same as those of the first embodiment.

In this way, the photosensitive drum cartridge 51 is positioned with respect to the printer main body 50 by the positioning bosses 63 of the supporting members 51 for supporting the photosensitive drum 52. Accordingly, it is not required to separately install members for performing the positioning, resulting in that the number of parts can be reduced.

The accurate positioning of the photosensitive drum cartridge 51 with respect to the printer main body 50 can be performed only by inserting the positioning bosses 63 into the insertion portions 65 and rotating the photosensitive drum cartridge 51.

It is a matter of course that the invention is not restricted to the embodiments described above, and that the embodiments may be modified or changed without departing from the scope of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A photosensitive drum cartridge for attachment with a printer main body, said cartridge comprising:

a photosensitive drum cartridge main body provided with a supporting member made of an elastic material for supporting a photosensitive drum, the supporting member comprising:

a supporting shaft for rotatably supporting the photosensitive drum;

and a base body means integrated with the supporting shaft for positioning the supporting shaft with respect to the photosensitive drum cartridge main body;

said base body means including a flat plate having a shape identical to a front end portion of a sidewall of the cartridge main body, said base body means also having an engaging body integrally formed at the center of said flat plate, said engaging body having an oval projection protruding from said flat plate, and a pair of engaging pieces integrally formed at right and left sides of said projection and separated from said flat plate by a predetermined distance, said supporting shaft projecting from the center of said projection.

2. A photosensitive drum cartridge as claimed in claim 1, wherein a positioning boss for positioning the photosensitive drum cartridge main body with respect to an image forming apparatus main body is integrally formed on said base body means of the supporting member, said positioning boss comprising a half-cylinder shaped projection formed integrally on an outer face of said flat plate, a positioning piece having a half-disk shape protruding from an under portion of said half-cylinder shaped projection so as to be separated from the flat plate by a gap having a greater thickness than a frame of said printer main body.

3. A photosensitive drum cartridge as claimed in claim 1, wherein the cartridge further comprises positioning means which performs the positioning of the supporting member by superposing said projection formed on the supporting member on a positioning hole formed in the cartridge main body.

4. An image forming apparatus comprising an image forming apparatus main body, and a photosensitive drum cartridge which is to be mounted to the image forming apparatus main body, said photosensitive drum cartridge comprising: a photosensitive drum cartridge main body provided with a supporting member made of an elastic material for supporting a photosensitive drum, the supporting member comprising:

a supporting shaft for rotatably supporting the photosensitive drum;

and a base body means integrated with the supporting shaft for positioning the supporting shaft with respect to the photosensitive drum cartridge main body;

said base body means including a flat plate having a shape identical to a front end portion of a sidewall of the cartridge main body, said base body means also having an engaging body integrally formed at the center of said flat plate, said engaging body having an oval projection protruding form said flat plate, and a pair of engaging pieces integrally formed at right and left sides of said projection and separated form said flat plate by a predetermined distance, said supporting shaft projecting from the center of said projection, wherein a positioning boss is formed on the photosensitive drum cartridge, said positioning boss comprising a half-cylinder shaped projection formed integrally on an outer face of said flat plate, a positioning piece having a half-disk shape protruding from an under portion of said half-cylinder shaped projection so as to be separated from the flat plate by a gap having a greater thickness than a frame of said printer main body, the image forming apparatus main body comprises an insertion portion into which the positioning boss is to be inserted, and the insertion portion comprises a positioning member for positioning the positioning boss in the vertical and horizontal directions through the rotation of the photosensitive drum cartridge.

* * * * *